United States Patent [19]

Koike et al.

[11] Patent Number: 4,954,849

[45] Date of Patent: Sep. 4, 1990

[54] COPYING APPARATUS OPERABLE IN A TWO-SIDE COPY MODE

[75] Inventors: Tadao Koike; Koichi Noguchi, both of Tokyo; Hiroshi Takahashi, Kawasaki; Koichi Tsunoda, Yokohama, all of Japan

[73] Assignee: Ricoh Company, Ltd., Tokyo, Japan

[21] Appl. No.: 370,187

[22] Filed: Jun. 22, 1989

[30] Foreign Application Priority Data

Jun. 23, 1988 [JP] Japan ..... 63-153609

[51] Int. Cl.[5] ..... G03G 21/00

[52] U.S. Cl. ..... 355/319; 271/3.1; 355/311

[58] Field of Search ..... 355/319, 318, 311, 24, 355/26; 271/3.1

[56] References Cited

U.S. PATENT DOCUMENTS

| | | | |
|---|---|---|---|
| 4,231,561 | 11/1980 | Kaneko et al. | 355/23 X |
| 4,264,067 | 4/1981 | Adams et al. | 271/902 X |
| 4,272,180 | 6/1981 | Satomi et al. | 355/319 X |
| 4,544,148 | 10/1985 | Kitajima et al. | 271/902 X |
| 4,639,125 | 1/1987 | Okuda et al. | 271/3.1 X |
| 4,650,313 | 3/1987 | Koike | 355/319 |
| 4,667,951 | 5/1987 | Honjo et al. | 271/902 X |
| 4,685,793 | 8/1987 | Sawada et al. | 355/311 |
| 4,739,369 | 4/1988 | Yoshiura et al. | 271/3.1 X |
| 4,744,553 | 5/1988 | Hirose | 355/23 X |
| 4,761,001 | 8/1988 | Hayakawa et al. | 271/902 X |
| 4,817,933 | 4/1989 | Honjo et al. | 271/3.1 |
| 4,831,411 | 5/1989 | Sugishima | 355/319 |
| 4,851,883 | 7/1989 | Ito | 355/203 X |

FOREIGN PATENT DOCUMENTS

| | | | |
|---|---|---|---|
| 0132251 | 8/1983 | Japan | 355/23 |
| 0021666 | 1/1987 | Japan | 271/186 |
| 0081654 | 4/1987 | Japan | 355/319 |
| 0041336 | 2/1988 | Japan | 271/186 |
| 0196426 | 8/1988 | Japan | 271/186 |
| 0196427 | 8/1988 | Japan | 271/186 |

*Primary Examiner*—A. T. Grimley
*Assistant Examiner*—Sandra L. Hoffman
*Attorney, Agent, or Firm*—Oblon, Spivak, McClelland, Maier & Neustadt

[57] ABSTRACT

A copying apparatus operable in a two-side copy mode has two exclusive switchback transport paths which are selectively usable for refeeding paper sheets each carrying an image on one side thereof from a refeed tray. One of the switchback transport paths is assigned to paper sheets of size A4 and smaller sizes which are fed sideways, while the other is assigned to paper sheets of sizes greater than A4.

2 Claims, 5 Drawing Sheets

COPYING APPARATUS OPERABLE IN A TWO-SIDE COPY MODE

BACKGROUND OF THE INVENTION

1. Field of the Invention

The present invention relates to a copying apparatus having a two-side copying function for use with an electrophotographic copier, facsimile machine, printer, etc.

2. Discussion of the Background

In a copying apparatus operable in a two-side copy mode, paper sheets each carrying an image on one side thereof are stacked temporarily on a refeed tray and, in response to a refeed command, fed out again from the refeed tray to an image forming station while being turned over so as to reproduce images on the other side thereof. This kind of copying apparatus has a switchback or two-side transport path for steering the paper sheets towards the refeed tray. It has been customary to drive all the paper sheets toward the refeed tray by way of the same transport path which is configured to match paper sheets of maximum size usable with the copying apparatus. This brings about a problem in that two-side copying with paper sheets of comparatively small sizes results in the waste of transport distance and, therefore, a waste of time.

SUMMARY OF THE INVENTION

It is therefore an object of the present invention to provide a copying apparatus having a two-side copying function which promotes efficient two-side copying with paper sheets of sizes which are frequently used.

It is another object of the present invention to provide a generally improved copying apparatus having a two-side copying function.

In accordance with the present invention, in a copying apparatus having a two-side copying function which reproduces an image representative of an original document on one side of a paper sheet by image forming units and an image fixing unit, stacks the resulting one-sided paper sheet temporarily on a refeed tray, refeeds the one-sided paper sheet in response to a refeed command while turning over the paper sheet, and reproduces an image representative of an original documents on the other side of the paper sheet by the image forming unit and image fixing unit, a first switchback transport path is located in close proximity to and downstream of the image fixing unit for transporting paper sheets of comparatively small sizes, while a second switchback transport path is located downstream of the first switchback transport path for transporting paper sheets of comparatively large sizes. Guide means selects either one of the first and second switchback transport paths and guides the paper sheets to the selected switchback transport path.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
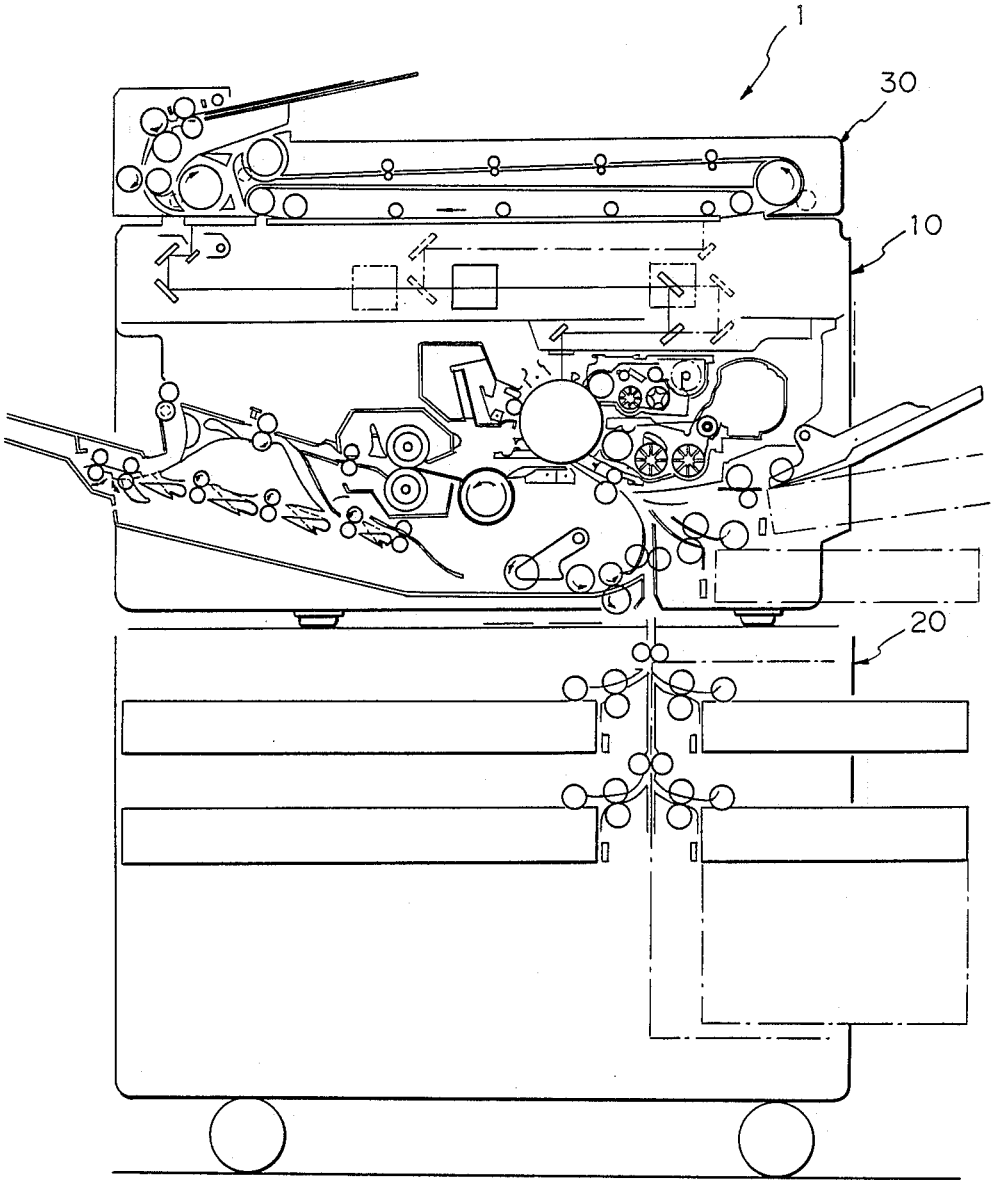
FIG. 1 is a vertical section of a copying apparatus embodying the present invention.

Referring to FIG. 1 of the drawings, a copying apparatus operable in a two-side copy mode embodying the present invention is shown and generally designated by the reference numeral 1. As shown, the copying apparatus 1 is mainly composed of a copier body 10 shown in FIG. 2, a mass paper feed section 20 shown in FIG. 3, and an ADF section 30 shown in FIG. 4.

Figure 2:
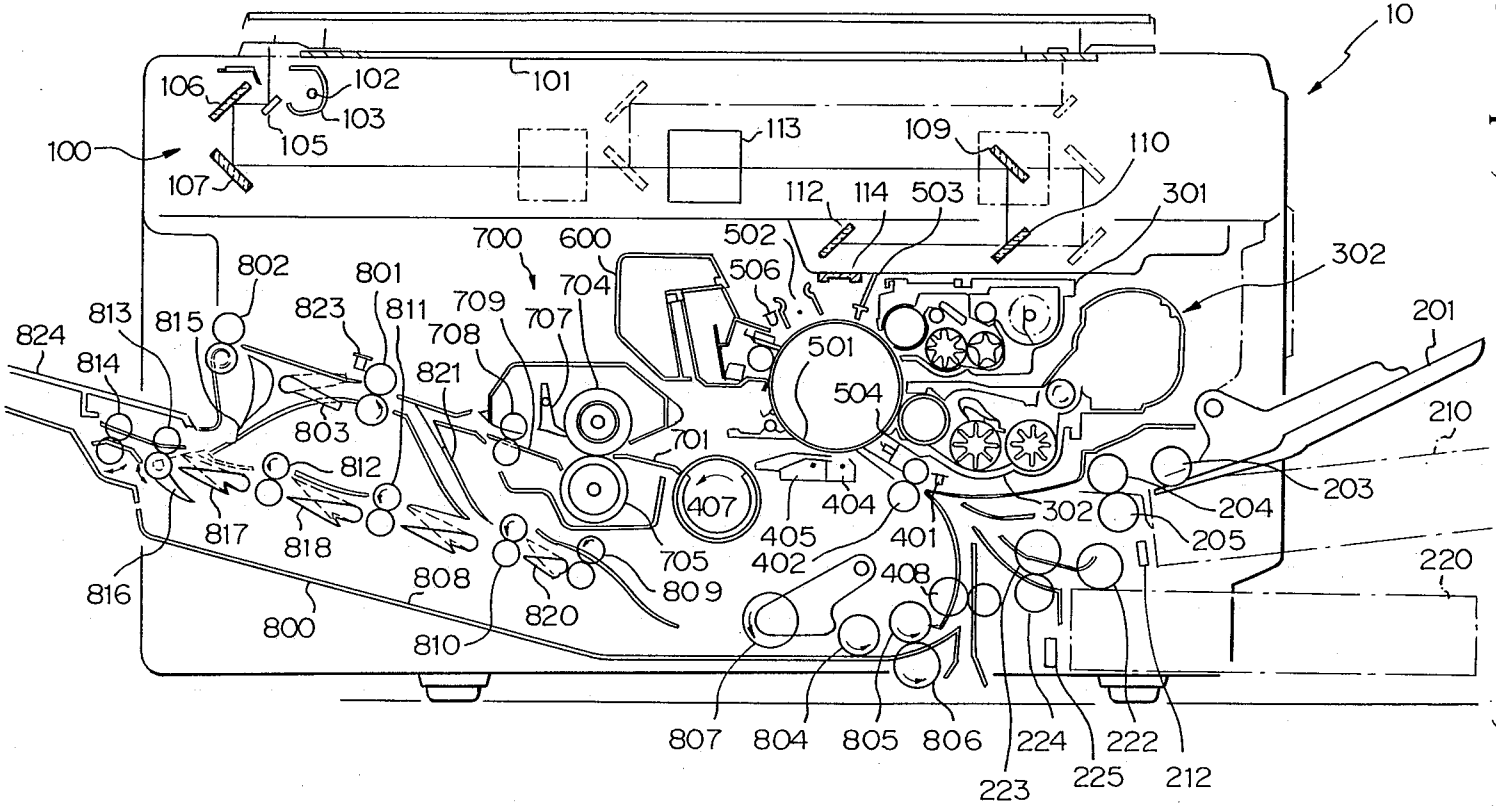
FIG. 2 is an enlarged vertical section showing a copier body of the apparatus shown in FIG. 1.

In the copier body 10 shown in FIG. 2, a photoconductive drum 501 is located substantially at the center of the copier body 10 and rotatable clockwise as viewed in the figure. Arranged around the drum 501 are a discharge lamp 506, a main charger 502, an erase lamp 503, a first developing device 301, a second developing device 302, pretransfer discharge lamp 504, a transfer charger 404, a separation charger 405, and a blade type cleaning device 600. Having a photoconductive surface layer, the drum 501 is uniformly charged by the discharge lamp 506 and main charger 502 and then exposed imagewise by optics 100. The optics 100 are disposed below a glass platen 101 to scan an original document and made up of a light source 102, movable mirrors 105, 106, 107, 109 and 110, a lens 113, and a stationary mirror 112. A motor (not shown) drives the mirrors 103, 106 and 107 such that the mirror 103 moves to the right as viewed in the figure at a speed of V/m, where V is the peripheral speed of the drum 501 and m is the magnification, while the mirrors 106 and 107 move at a speed of V/2 m. The peripheral speed of the drum 501 remains constant with no regard to the magnification. To change the magnification, the lens 113 and mirrors 109 and 110 are individually moved to set up an optical path having a particular length. The optics is isolated from the other image forming arrangements by a dust glass 114.

Paper feed sections 210 and 220 are located at the right-hand side of the copier body 10. The paper feed section 210 has a pick-up roller 203, a feed roller 204 and a separation roller 205, while the sheet feed section 220 has a pick-up roller 222, a feed roller 223 and a separation roller 224. A register roller pair 402, a suction roller 407, a fixing device 700, a discharge intermediate roller 801 and a body discharge roller 802 cooperate to define a paper transport path. Switches 212 and 225 are provided for sensing the size of papers being fed. A sensor 401 is located ahead of the register roller pair 402 with respect to an intended direction of paper for the purpose of on/off controlling the register roller pair 402. A manual paper feed section 201 is disposed above the paper feed section 210, so that one may select either one of manual paper feed and casette type paper feed as desired. A size sensor (not shown) is associated with the manual paper feed section 201 for sensing the widthwide dimension of a paper sheet. The manual paper feed section 201 is openable and, when opened, allows paper sheets to be fed by hand by cancelling the force of an arm (not shown) which presses paper sheets stacked in a cassette.

A paper sheet fed from the manual sheet feed section 201 or the cassette type sheet feed section 210 or 220 is driven by the register roller pair 402 at a predetermined timing associated with a toner image which is formed on the drum 501. The transfer charger 404 transfers the toner image from the drum 501 to the upper surface of the paper sheet, and then the separation charger 405 separates the paper sheet from the drum 501. The suction roller 407 transports the separated paper sheet toward a guide plate 701 which forms a part of the fixing unit 700, while sucking it. A fixing roller 704 and a pressing roller 705 included in the fixing device 700 cooperate to fix the toner image on the paper sheet. A separator in the form of a pawl 707 separates the paper sheet carrying the fixed toner image thereon from the fixing roller 704. Then, a discharge roller pair 708 also included in the fixing device 700 drives the paper sheet out of the device 700 toward the discharge intermediate roller 801. At this instant, a gate 803 is positioned as indicated by a phantom line in the figure so that the paper sheet is transported toward a refeed line to be caught by reverse rollers 813 and 814. On the lapse of a predetermined period of time after a paper sensor 823 has sensed the trailing edge of the paper sheet, a gate 816 is brought to a position indicated by a phantom line in a figure while the reverse rollers 813 and 814 are caused into counterclockwise rotation. Consequently, the paper sheet is driven by the reverse rollers 813 and 814 toward the body discharge roller 802 along a gate 815. The paper sheet is fed out of the copier body 10 onto a tray 824 face down. A lower end portion of the gate 815 is formed of a flexible film so that, once the paper sheet moves away from the gate 815, the gate 815 does not return to its original position.

In the above-described one-side copy mode, since the ADF section 30 which will be described feeds documents in the order of the pages copies are produced in the order of the pages because the paper sheets are sequentially stacked on the tray 824 face down.

A refeed section and a transport section 800 are arranged from the left-hand side to the center of the lower part of the copier body 10 so as to implement a two-side copy mode. A transport path assigned to a two-side copy mode is so configured as to cope with two different cases: a case wherein paper sheets of size A4 and other comparatively small sizes are fed sideways, and a case wherein paper sheets of sizes greater than A4 are fed. When images are to be reproduced on opposite sides of a paper sheet of size A4 or smaller size which is fed sideways, the paper sheet carrying an image on one surface thereof is driven by the roller pair 708 of the fixing device 700 to the discharge intermediate roller 801. At this instant, the gate 803 is held in a position indicated by a solid line to steer the paper sheet toward the body discharge roller 802. As soon as the paper sensor 823 senses the trailing edge of the paper, the rollers 801 and 802 are rotated in the reverse direction to drive the paper sheet toward a guide plate 821, the trailing edge being first. The guide plate 821 defines a switchback transport path for paper sheets of comparative small sizes. A transport roller pair 810 catches the paper sheet coming out of the switchback transport path. When the paper sheet is of size A5 and fed sideways or of half letter (HLT) size, a gate 802 is positioned as indicated by a solid so that the paper sheet is stacked on a refeed tray 808 by a transport roller pair 809. When the paper sheet is of size A4 or B5 and fed sideways, the gate 820 is held in position indicated by a phantom line and, hence, the paper sheet having moved away from the transport roller pair 810 is immediately driven toward the refeed tray 808. In a so-called 1-to-N copy mode available to produce a plurality of (N) reproductions of a single document the above operation is repeated to sequentially stack the resulting one-sided copies on the refeed tray 808. A pull-in roller 807 neatly arranges the leading edges of the paper sheets being stacked on the refeed tray 808. On the start of an operation for reproducing images on the other side of the paper sheets, a pull-out roller 804 drives the uppermost paper sheet on the refeed tray 808 while a feed roller 805 and a separation roller 806 cooperate to separate the single paper sheet from the others. The paper sheet is transported by the transport roller pair 408 to the register roller pair 402. At this time, the register roller pair 402 drives the paper sheet at a predetermined timing associated with the leading edge of an image which is printed on the second surface (on the back in the case of a two-sided document). This is followed by the same procedure as discussed in relation to the one-side copy mode. When the paper sheet carrying images on both sides thereof reaches the discharge intermediate roller 801, the gate 803 is held in the solid-line position to allow the paper sheet to advance to the tray 824 via the body discharge roller pair 802. The paper sheet is stacked on the tray 824 with its first surface facing downward.

When images are to be reproduced on both surfaces of a paper sheet of size A4 or greater size which is fed lengthways, the gate 803 is held in the phantom-line position. In this condition, the paper sheet which has reached the discharge intermediate roller 801 is steered toward the transport roller 813 which defines a switchback transport path for paper sheets of comparatively large sizes. On the lapse of a predetermined period of time after the paper sensor 823 has sensed the trailing edge of the paper sheet, the reverse rollers 813 and 814 are driven in the reverse direction to switch back the paper sheet resulting in the leading and trailing edges of the paper sheet replacing each other. When the paper size is A3 or 17 inches (42.18 centimeters), the gate 817 is brought to the phantom-line position to feed the paper sheet immediately to the refeed tray 808. When the paper size is B4 or 14 inches (35.56 centimeters), the gate 818 is positioned as indicated by a phantom line to feed the paper sheet to the refeed tray 808; when a paper sheet of size A4 or B5 is fed lengthways, the gate 811 is positioned as indicated by a phantom line to steer the paper sheet is the refeed tray 808. The procedure from the refeed to the discharge of the paper sheet is the same as with the paper sheet of size A4 or smaller size which is fed sideways.

The above-stated path configuration causes paper sheets of sizes A4 and smaller sizes which are fed sideways to be switched back earlier than paper sheets of sizes greater the size A4 and thereby allows the former to be stacked on the refeed tray 808 within a shorter period of time than the latter.

Figure 3:
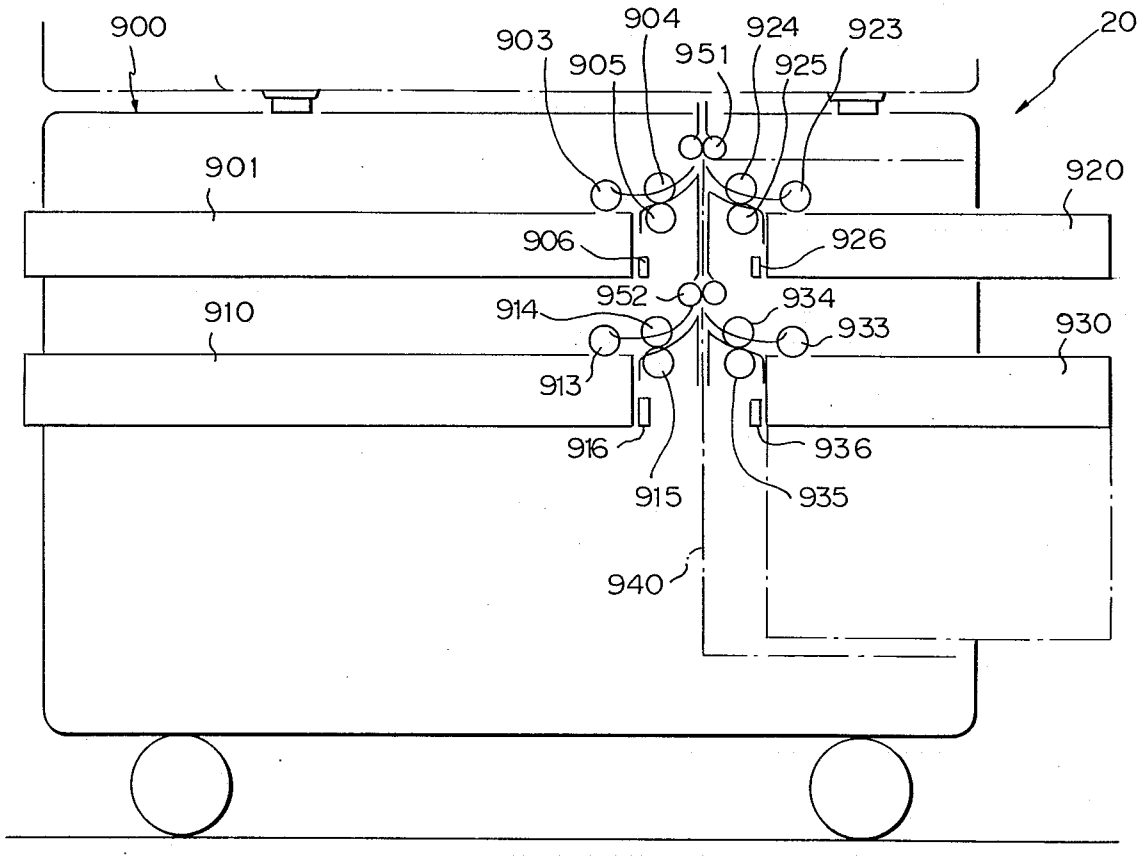
FIG. 3 is a vertical section showing a mass paper feed section of the apparatus shown in FIG. 1.

The copier body 10 has two cassette type paper feed sections 210 and 220 and one manual paper feed section 201, as stated earlier. The mass paper feed section 30 is available for accommodating a larger number of paper sizes and is implemented as a multi-stage paper feed unit 900, as shown in FIG. 3. Connected to the bottom of the copier body 10, the multi-stage paper feed unit 900 has a third, a fourth, a fifth and a sixth paper feed subunits 901, 910, 920 and 930, respectively. Among the subunits 910 to 930, the subunit 930 is configured to accommodate a large amount of paper sheets. Paper sheets are fed from the subunits 901 to 930 in the same manner as in the copier body 10 by a reverse roller feed principle. Specifically, the subunits 901 to 930 are provided with pick-up rollers 903, 913, 923 and 933, feed rollers 904, 913, 924 and 934, and separation rollers 905, 915, 9125 and 935. Roller pairs 951 and 952 are adapted for paper transport. Paper size sensing switches 906, 916, 926 and 936 are associated with the subunits 901 and 910 so as to sense the sizes of paper sheets which are loaded in the associated cassettes.

The operation of the multi-stage paper feed unit 900 will be described taking the fourth paper feed subunit 910 as an example. The pick-up roller 913 feeds some paper sheets together, while the feed roller 914 which rotates clockwise and the separation roller 915 which rotates counterclockwise while the torque is smaller than a predetermined torque drive only one of the paper sheets to the transport roller pair 952. The transport roller pair 952 delivers the paper sheet to the register roller pair 402 via the transport roller pair 951 and the transport roller pair 408 of the copier body 10. The paper sheet being transported actuates the sensor 401 so that the transport roller pairs 408, 951 and 952 are deactivated on the lapse of a predetermined period of time. Subsequently, the paper sheet is driven toward the drum 501 timed to a toner image which is formed on the drum 501, as has been the case with the paper sheets fed from the paper feed sections of the copier body 10.

Figure 4:
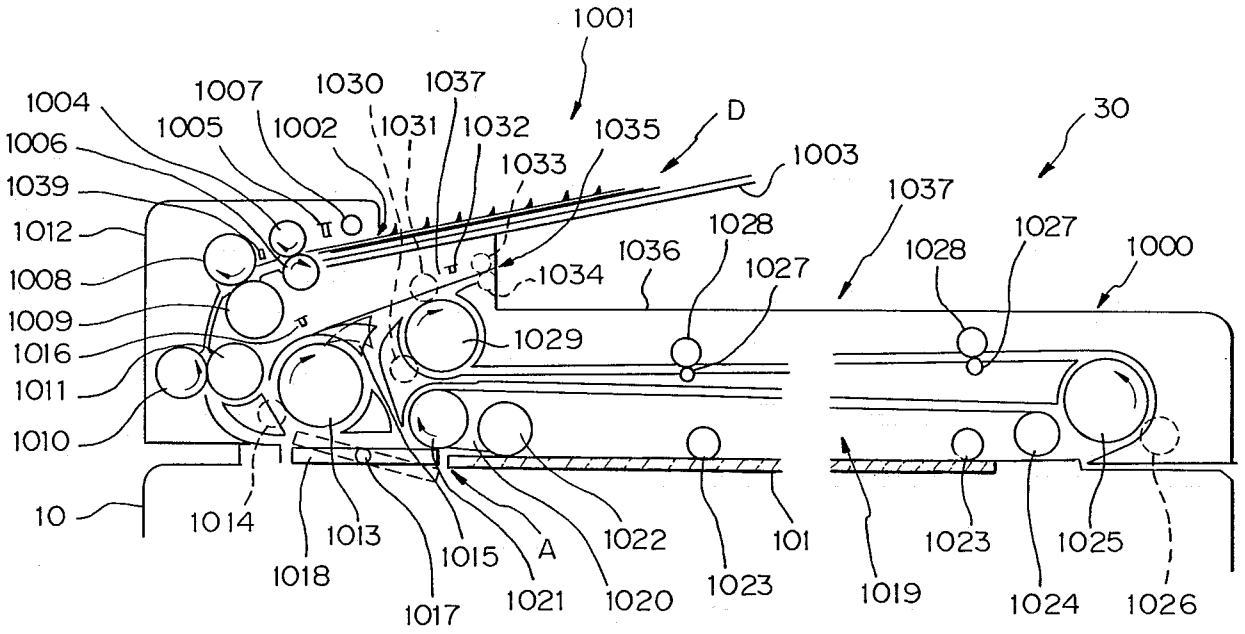
FIG. 4 is an enlarged vertical section of an automatic document feeder (ADF) section of the apparatus shown in FIG. 1.

In FIG. 4, the multi-stage paper feed unit 900 is shown as being loaded with cassettes of comparatively large sizes at its left-hand side and cassettes of comparatively small sizes at its right-hand side. However, such an arrangement is only illustrative. That part of the unit 900 which is indicated by a phantom line 940 is openable to remove a paper sheet which may jam the paper transport path defined in the unit 900. The four subunits 901 to 930 are arranged at opposite sides of the unit 900 in order to shorten the transport paths and, therefore, transport times as far as possible and to avoid the location of a cassette close to the floor which would result in poor manipulability.

Referring to FIG. 4, the ADF section 30 has an ADF 1000 which is disposed above the glass platen 101 of the copier body 10. The ADF 1000 has a document feed subsection 1001, a reverse subsection 1012, a transport subsection 1019, and a discharge subsection 1037. The document feed subsection 1001 has a tray 1003, a pick-up roller 1004, a separation roller 1006, and a check roller 1007. Documents are stacked on the tray 1003 face up and in the order of page. The reverse subsection 1012 includes a reverse roller 1013, a driven roller 1014 and a deflector 1015. The transport subsection 1019 includes an endless belt 1020 which is driven by a drive roller 1021, a positioning roller 1022, a driven roller 1025, a pressing roller 1023, a drive pull-out roller 1025, a driven pull-out roller 1026, and transport rollers 1027 and 1028. Further, the discharge section 1037 includes reverse discharge rollers 1029 and 1030, a discharge guide roller 1031, and discharge rollers 10933 and 1034. There are also shown in FIG. 4 a document inlet 1005, sensors 1005, 1016, 1032 and 1039, pull-out rollers 1008 1009, 1010 and 1011, a reference scale 1018 which has a flat surface contiguous with the glass platen 101 and is rotatable about a fulcrum 1017 to serve as a stop for stopping documents, a document outlet 1035, a document receiver 1036, and a reference position A defined on the copier body 100 for scanning a document.

The operation of the ADF will be described taking the commonest case wherein reproductions of one-sided documents are desired, as an example. One of documents D which are stacked on the tray 1003 is fed by the pick-up roller 1004, separation roller 1006 and check roller 1007 to the pull-out rollers 1008 an 1010. These rollers 1008 and 1010 drive the document D to the glass platen 101 by way of the reference scale 1018. The sensor 1039 senses the length of the document D with respect to the direction of transport, whereby the period of time for driving the belt 1020 is determined. The sensor 1005 is responsive to the presence/absence of the document D. After the document D has been transported by the belt 1021 until its trailing edge has moved away from the reference position A, the drive roller 1021 is rotated clockwise to move the belt 1020 to the left. As a result, the document D is caused to abut against the reference scale 1018 and thereby located in the reference position A. The belt 1020 is continuously rotated even after the abutment of the document D against the reference scale 1018 so as to correct the registration and skew of the document D, and then it is brought to a halt. At this instant, the belt 1020 and the document D slip on each other. As the optics completes imagewise exposure, the drive roller 1021 is rotated counterclockwise to transport the document D to the right toward the drive pull-out roller 1025. The document D is turned over by a generally U-shaped guide and transported by the transport rollers 1027 an 1028 which are situated in the transport subsection 1019. At this stage of movement, the document D is positioned face up. The document D is further turned over by the reverse discharge roller 1029 and then discharged onto the document receiver 1036 by way of the discharge guide roller 1031, discharge roller 1034, and outlet 1035. In this manner, the documents D are sequentially stacked face down in the order of page.

Assume that the ADF 1000 is operated to reproduce two-sided documents D, the front of each document D being first. Such a document D is brought into abutment against the reference scale 1018 by the above-described procedure. After the front of the document D has been reproduced, the drive roller 1021 is rotated clockwise to cause the belt 1020 to feed the document D to the reverse subsection 1012. Before the drive roller 1021 is so rotated, the reference scale 1018 is rotated about the fulcrum 1017 by a mechanism which includes a solenoid and a spring to a position indicated by a phantom line in the figure. In this position, the reference scale 108 does not interfere with the transport of the document D and serves to guide the document D being driven from the glass platen 101 toward the reverse subsection 1012. The reverse roller 1013 and the deflector 1015, which is held in a position indicated by a solid line, drive the document D to the glass platen 101 while turning it over. As soon as the sensor 1016 sense the leading edge of the document D, the drive roller 1021 is rotated counterclockwise to move the belt 1020 to the right, i.e., toward the glass platen 101. This is followed by the same procedure as has been described in relation to the front of the document D. After the back of the document D has been reproduced, the reference scale 1018 is retracted to the phantom-line position to feed the document D to the reverse subsection 1012. At this instant, the deflector pawl 1015 is brought to a phantom-line position to inhibit the document D from being routed back to the glass platen 101. In this condition, the document D is steered by the deflector pawl 1015 to the discharge subsection 1037. The reverse discharge roller 1029 and roller 1034 discharge the document D to the document receiver 1036 via the outlet 1035. Again, such documents are sequentially stacked face down in the order of page.

Figure 5:
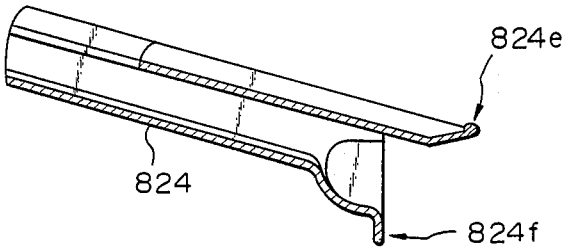
FIG. 5 is a vertical section of a copy tray of the apparatus shown in FIG. 1.
Figure 6:
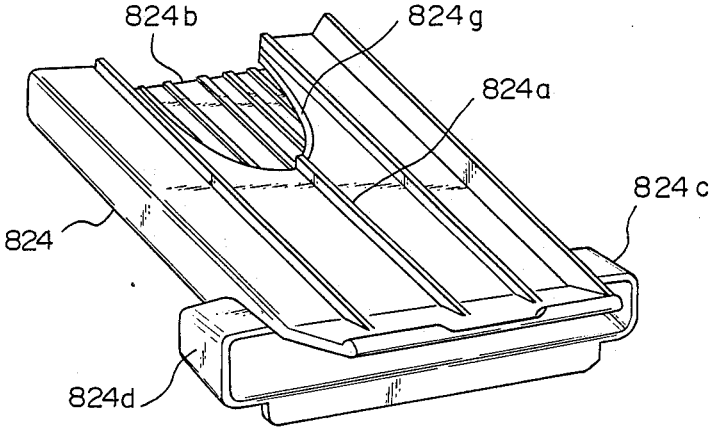
FIG. 6 is a perspective view of the copy tray.

FIGS. 5 and 6 show a specific configuration of the tray 824. As shown, the tray 824 has projections **824*e* at its inner end and a downward extension 824*e*. The tray 824 is connected to and retained by the copier body 10 with the projections 824*e* mating with a slot (not shown) of the copier body 10 and with the extension 824*f* abutting against a flat wall of the copier body 10. The tray 824 has ribs 824*a* for reducing the resistance to paper sheets while the latter is stacked, and ribs 824*b* for reducing the resistance to paper sheets in a two-side copy mode and at the time of reverse discharge. The outer end of the tray 824 is provided with a notch 824*g* for facilitating the removal of a stack of paper sheets or copies. Projections 824*c* and 824 *d* are adapted to accommodate the reverse rollers and other mechanical parts. When a paper sheet jams the copier body 10 in the event of reverse discharge or in a two-side copy mode, the jamming sheet can be pulled out with ease by raising the tray 824 slightly and then pulling it out of the copier body 10**.

In summary, it will be seen that the present invention provides a copying apparatus having a two-side copying function which enhances efficient two-side copying with paper sheet of sizes which are frequently used such as A4 and B5, while freeing one from a disproportionate waiting time.

Various modifications will become possible for those skilled in the art after receiving the teachings of the present disclosure without departing from the scope thereof.

What is claimed is:

1. A copying apparatus having a two-side copying function which reproduces an image representative of an original document on one side of a paper sheet by image forming means and image fixing means, stacks the resulting one-sided paper sheet temporarily on a refeed tray, refeeds said one-sided paper sheet in response to a refeed command while turning over said paper sheet, and reproduces an image representative of an original document on the other side of said paper sheet by said image forming means and said image fixing means, said apparatus comprising:

a first switchback transport path located in close proximity to and downstream of the image fixing means for transporting paper sheets of comparatively small sizes to said refeed tray;

a second switchback transport path located downstream of said first switchback transport path for transporting paper sheets of comparatively large sizes to said refeed tray; and guide means positioned on said second switchback transport path tray for selecting either one of said first and second switchback transport paths and guiding the paper sheets to said selected switchback transport path.

2. A copying apparatus as claimed in claim 1, wherein the paper sheets of comparatively small sizes are paper sheets of size A4 and smaller sizes which are fed sideways, while the paper sheets of comparatively large sizes are paper sheets of sizes greater than A4 which are fed sideways.

* * * * *